US008730643B2

(12) United States Patent
Formon et al.

(10) Patent No.: US 8,730,643 B2
(45) Date of Patent: May 20, 2014

(54) APPARATUS WITH ARC GENERATOR FOR DISPENSING ABSORBENT SHEET PRODUCTS

(75) Inventors: John S. Formon, Oxford, PA (US); Russell G. Wieser, Downingtown, PA (US); Joseph Wieser, Downingtown, PA (US)

(73) Assignee: SCA Hygiene Products AB, Göteborg (SE)

( * ) Notice: Subject to any disclaimer, the term of this patent is extended or adjusted under 35 U.S.C. 154(b) by 449 days.

(21) Appl. No.: 12/910,066

(22) Filed: Oct. 22, 2010

(65) Prior Publication Data

US 2012/0097699 A1 Apr. 26, 2012

(51) Int. Cl.
*H05F 3/00* (2006.01)

(52) U.S. Cl.
USPC ..... 361/221; 361/214

(58) Field of Classification Search
USPC ..... 361/214, 221
See application file for complete search history.

(56) References Cited

U.S. PATENT DOCUMENTS

| | | | | |
|---|---|---|---|---|
| 3,636,408 | A | 1/1972 | Shuman | |
| 4,494,166 | A * | 1/1985 | Billings et al. | 361/214 |
| 4,831,488 | A | 5/1989 | Playe | |
| 5,149,655 | A * | 9/1992 | McCabe et al. | 604/57 |
| 6,178,078 | B1 * | 1/2001 | Yamanishi | 361/117 |
| 6,253,037 | B1 * | 6/2001 | Park | 399/44 |
| 6,871,815 | B2 | 3/2005 | Moody et al. | |
| 6,920,030 | B2 * | 7/2005 | Chase et al. | 361/214 |
| 7,017,856 | B2 | 3/2006 | Moody et al. | |
| 2008/0043086 | A1 * | 2/2008 | Cheng et al. | 347/141 |

FOREIGN PATENT DOCUMENTS

| | | | |
|---|---|---|---|
| EP | 0207513 | A1 | 1/1987 |
| EP | 1230886 | A1 | 8/2002 |
| JP | 63295344 | A | 12/1988 |
| WO | 2008/053393 | A2 | 5/2008 |

OTHER PUBLICATIONS

International Search Report dated Feb. 27, 2012, from corresponding PCT application.

* cited by examiner

*Primary Examiner* — Stephen W Jackson
*Assistant Examiner* — Tien Mai
(74) *Attorney, Agent, or Firm* — Buchanan Ingersoll & Rooney PC

(57) ABSTRACT

A dispenser can include a charge collector, an arc gap and a ground, where the arc gap is between the charge collector and the ground. The arc gap provides high impedance and can be set to a distance of from about 0.1 to about 0.01 inches. The technology operates by collecting charge from at one charge generating site with at least one charge collector and sending the charge to ground through the arc gap, the arc gap being between the at least one charge collector and the ground.

20 Claims, 13 Drawing Sheets

APPARATUS WITH ARC GENERATOR FOR DISPENSING ABSORBENT SHEET PRODUCTS

BACKGROUND OF THE INVENTION

1. Field of the Invention

An arc generator produces a high impedance path to ground to eliminate electrostatic charges in dispensers.

2. Description of the Related Art

Conventional dispensers for absorbent sheet products include a store with an absorbent web which is to be dispensed. The web is conveyed with at least one conveying element for feeding the absorbent web to a position where it is cut so as to form separate absorbent sheet products for a user.

In dispensers for absorbent material, like tissue material, a build-up of electrostatic charge can be observed. When two bodies of different material are in contact which each other, there is migration of electrons between the two surfaces. The number of electrons that migrate is dependent on the difference in the so called work function of the two materials. The term "work function" stands for the energy required to remove an electron from the surface of a specific material to infinite. A material with a lower work function acts as a donor. From such donor material, the electrons migrate to the acceptor material with the higher work function. If the two bodies suddenly are separated from each other, the electrons try to return to their parent material. In the cases were the material is conductive, this is possible and the electrons migrate back to their parent material. However, if one or both of the two bodies are insulating materials, this will not happen. As a result, electrons get trapped in the surface of the material to which they have migrated.

Static electricity generates high voltages with low currents. Commonly accepted Standard IEC 61000-4-2 limits the allowable maximum voltage level to an amount smaller than ±8000 V. If the electrostatic charge exceeds this maximum voltage, it might affect other electrical components. Further, it is even possible that a user might be exposed to unpleasant discharges.

Various factors influence the build-up of electrostatic charges. The first factor is the type of material. In order to create an electrostatic build-up two bodies have to be in contact with each other, where at least one of them should be a bad conductor. When there are two bodies of dissimilar material it could cause the material to charge even more than when two similar materials are in contact with each other. This is the effect of the dielectric constant, or the work function. A material with high relative permittivity (the electric constant) becomes positively charged when it is separated from a material with low permittivity. A second factor is the contact area between dissimilar materials. The larger the contact area is, the more electrons migrate between the materials. As a result of this, a large contact area promotes a high electrostatic charge build-up. A third factor is the separation speed. The higher the speed of separation of the two materials is, the less is the possibility for the electrons to move back to the parent material. A higher separation speed results in a higher charge build-up.

A further influencing factor is a possible motion between the materials. Firstly, the local heat generated by the friction between materials increases the energy level of the atoms making the escape of electrons easier. Secondly, a movement causes better surface contact by bringing the microscopic irregularities on both surfaces in contact with each other thus increasing the possibility of the electrons to migrate from one material to the other. The same applies for a higher temperature which results in easier release of electrons due to the higher energy level. Finally, atmospheric conditions can also influence the build-up of electrostatic charge. The more moisture there is in the atmosphere, the better is the ability of discharge. However, this is not true for all materials. For dispensers of the kind as stated above, however, the observation has been made that the electrostatic build-up tends to be higher in winter where the relative humidity of the ambient air is usually smaller.

Measurements show that the parts in a conventional dispenser which generate electrostatic charges are the conveying rolls and the knife or tear bar for severing the web into individual sheets. The paper leaves a dispenser positively charged so that the dispenser apparatus itself experiences a build-up of negative electrostatic charges.

Conventional art solutions (such as in U.S. Pat. No. 6,871,815 and U.S. Pat. No. 7,017,856) include systems in which a low impedance, high conductivity pathway, like a wire, is used to connect internal components of the dispenser that are subject to static charge build-up to a mechanical contact on the back of the dispenser housing. This contact, in turn, makes contact with the supporting wall upon which the dispenser is mounted, with the premise being that any static charge will be dissipated by the wall.

Another conventional approach described in WO2008/053393 would be to provide an electronic dispenser incorporating a passive, self-discharging static charge dissipating material incorporated with at least an internal component within the internal volume of the housing that stores static charge generated by operation of the dispenser. The web material is directed over the static charge dissipating material as it is conveyed through the dispenser in order to reduce the electrostatic load of the web material leaving the dispenser.

However, there is still a need to find more efficient technologies to dissipate electrostatic electricity generated in dispensers.

SUMMARY OF THE INVENTION

Electrostatic charges in dispensers or other devices are eliminated by an arc generator that produces a high impedance path to ground.

The dispenser or other device can include a charge collector and an arc gap connected to a grounded conductor, where the arc gap may be between the charge collector and the grounded conductor. The arc gap may be adjustable and from about 0.1 to about 0.01 inches, from about 0.05 to about 0.075 inches or from about 0.07 to about 0.075 inches. The charge collector can be at least one conductive brush formed from graphite, copper wire, aluminum wire or steel wire, or a slip ring. The brushes can form at least one row. The charge collector, the arc gap and the ground can be by conductive bands or wire located either inside or outside a housing of the dispenser.

Removal of the electrostatic charge is effected by collecting charge from at least one charge generating site with at least one charge collector, and sending the charge to ground through an arc gap, the arc gap being between the at least one charge collector and the ground.

BRIEF DESCRIPTION OF THE DRAWING FIGURES

In the following, the invention will be briefly discussed, by way of example only, by reference to the accompanying drawings.

FIG. 1 schematically shows the relevant parts of a dispenser.

FIG. 2 shows the major components of the conveying device as well as a tear bar of an apparatus for dispensing.

FIG. 3 conceptually shows the technology.

DETAILED DESCRIPTION OF THE INVENTION

Static electricity in a dispenser can be eliminated by providing a high impedance path to ground from a generator of static charge, e.g., a pinch roll or a tear bar. The high impedance can be provided by an arc gap, which can also be referred to as a spark gap. The arc gap is defined by the facing conductive elements separated from one another by a predetermined distance, the gap itself being the air between those elements.

Figure 1:
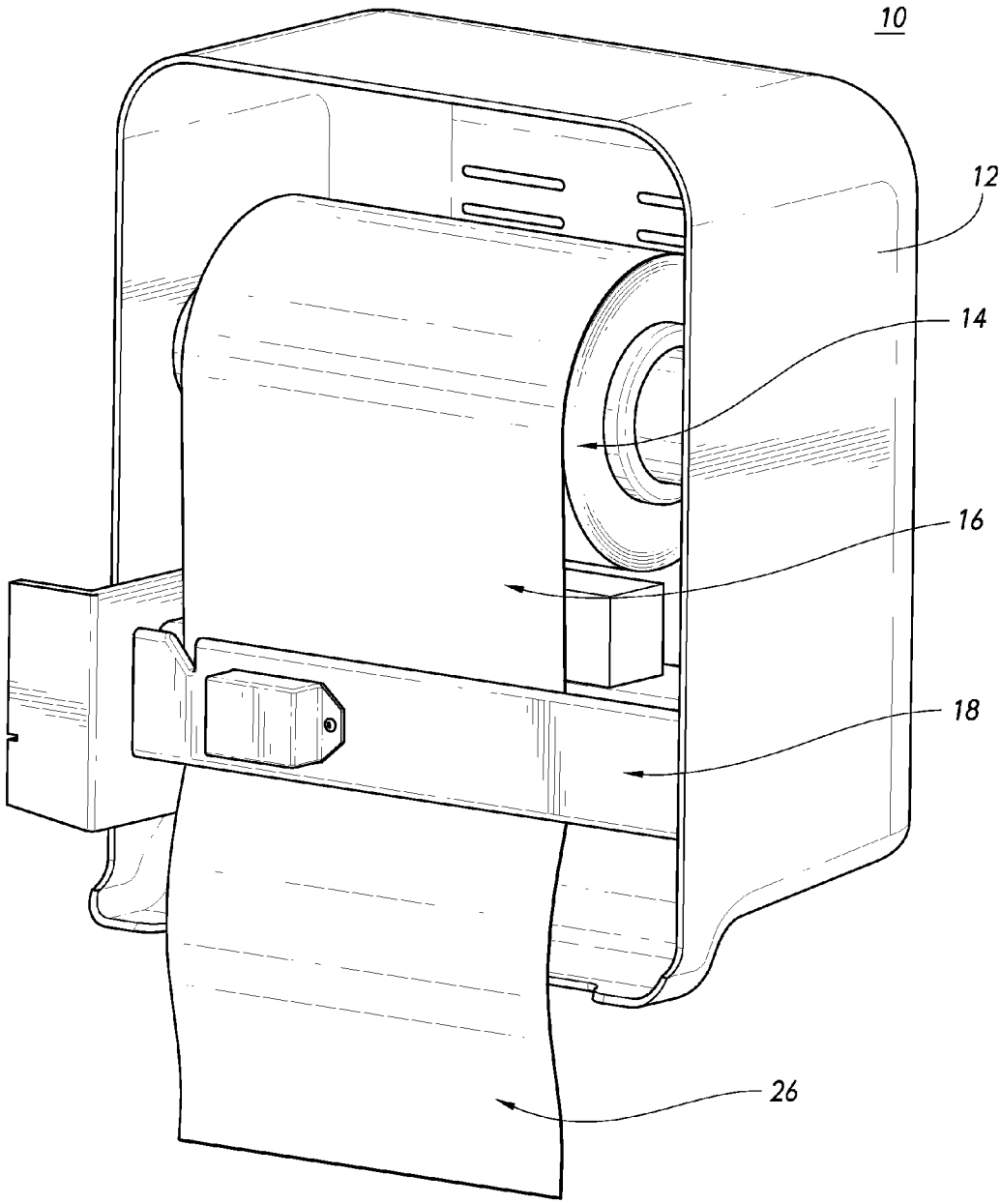

FIG. 1 schematically shows a dispenser with its front shell removed in order to see the main parts of such dispenser.

The dispenser generally denoted by reference numeral 10 has a housing which includes at least two parts. The back shell 12 as shown in FIG. 1 can be affixed to a wall. The front shell (not shown) closes the dispenser and only leaves a slot through which the product can be dispensed.

Figure 2:
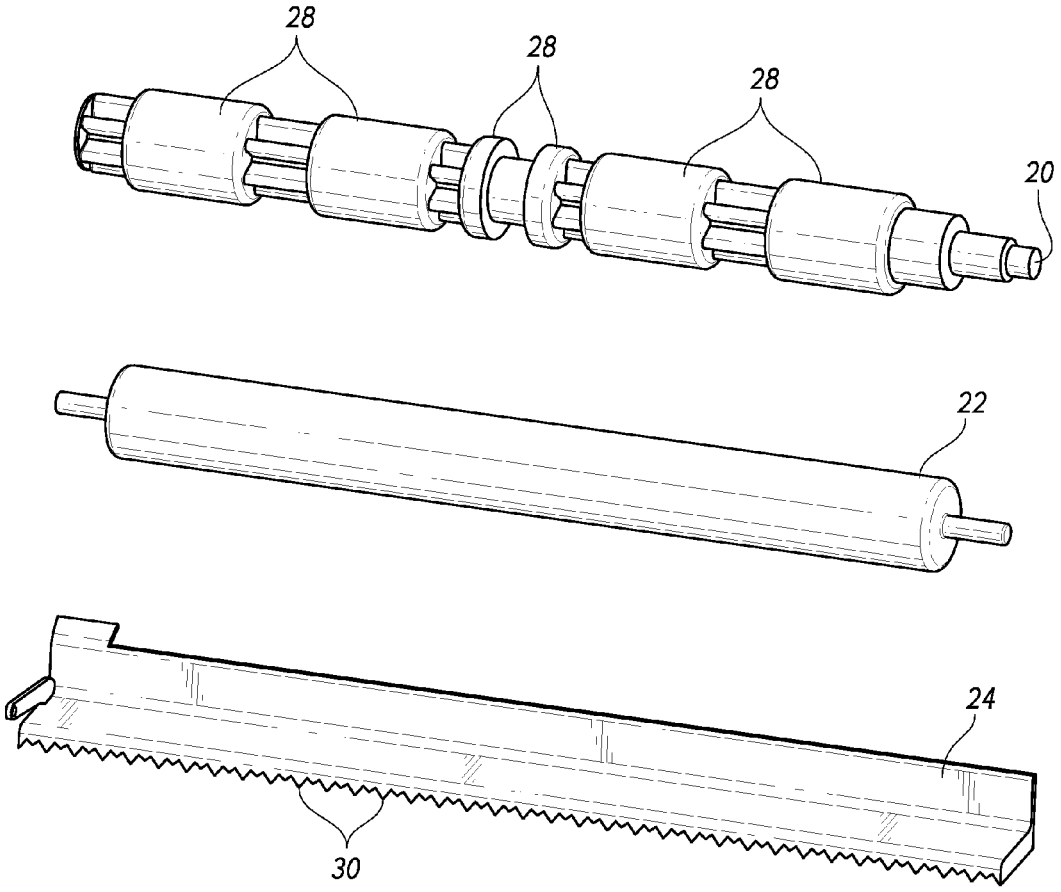

Inside the dispenser, there may be a feed roll 14 on which an absorbent web 16 is wound. This is just an example and, as outlined above, other types of dispensers can also be used to realize the invention, like dispensers in which the absorbent web is stored as a folded stack. In the exemplary dispenser as shown in FIG. 1, the absorbent web 16 is wound from the feed roll 14 and passes through a conveying unit 18 which mainly includes a drive roll 20, a guide roll 22 and a tear bar 24, as shown in FIG. 2. The absorbent web 16 leaves the dispenser at position 26 where there is a slot in the front shell of the dispenser through which the absorbent product extends and can be removed by a user.

The main parts of the conveying unit 18 as shown in FIG. 1 are individually exemplified in FIG. 2. The absorbent web to be dispensed passes through the nip between a drive roll 20 and a guide roll 22 which, in FIG. 2, are individually shown without the correct mutual arrangement. In an attempt to provide for good friction between the conveying unit and the absorbent web, the drive roll 20 might be provided with wheels or rings 28 of a high friction component, like a suitable plastic material or rubber. The guide roll 22 can be made of any suitable material which cooperates with the drive roll to achieve a safe transport of the absorbent web between drive roll 20 and guide roll 22.

FIG. 2 also exemplifies the possible size and shape of a tear bar which might be a part of the conveying unit 18 so that the servicing of the dispenser consisting of individual modules might be simplified. However, it is also possible to provide a tear bar 24 separately to the conveying unit. In that case, the tear bar 24 is separately affixed to the housing of the dispenser. Tear bar 24 is provided with cutting teeth 30 which can be used by a user to sever a suitable length of the absorbent web. The invention is not restricted to this specific type of dispenser and it is also possible to provide tear bars cooperating with the conveying unit in order to automatically sever a metered length of absorbent sheet.

It has been found that, during operation, most static load builds-up at the three components as shown in FIG. 2. Drive roll 20, guide roll 22 and tear bar 24 get negatively charged, whereas the absorbent web, especially tissue paper, leaving the dispenser is positively charged.

The dispensing apparatus shown in FIG. 1 and FIG. 2 is merely exemplary. The apparatus for dispensing is not limited to any particular type of dispenser and has utility for any dispenser wherein it is desired to reduce the generation of charges by providing a greatly reduced contact area between a conveying element and the absorbent web. The dispenser may be a "hands free" dispenser that is automatically actuated upon detection of an object placed within a defined detection zone. In alternative embodiments, the dispenser may be actuated upon the user pressing a button, switch or manual actuating device to initiate a dispense cycle. The dispenser may as well be of such type where the user grasps the absorbent material to be dispensed and pulls out a metered length of such absorbent material.

The store within the apparatus may be a roll on which an absorbent web is wound. It might as well be a store in which the web material is folded to a stack.

Figure 3:
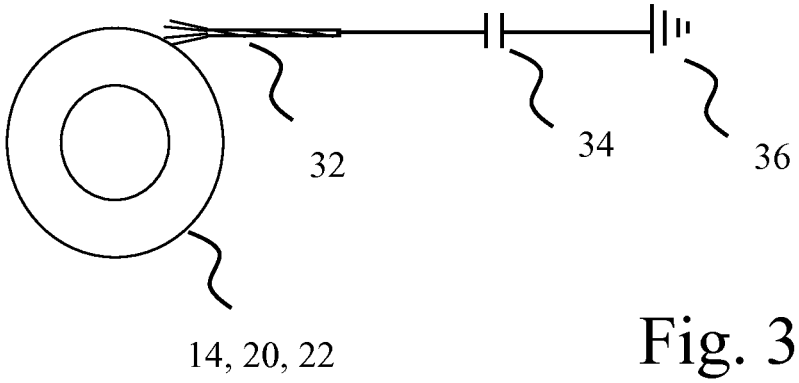

FIG. 3 conceptually shows the technology. Static electricity is generated on a site such as the feed roll 14, drive roll 20 or guide roll 22. The static electricity can also be generated at the tear bar 24. The charge is picked up by a conductive brush 32 and is conducted to an arc gap (also called a spark gap) 34, which is then sent to ground 36.

Figure 4:
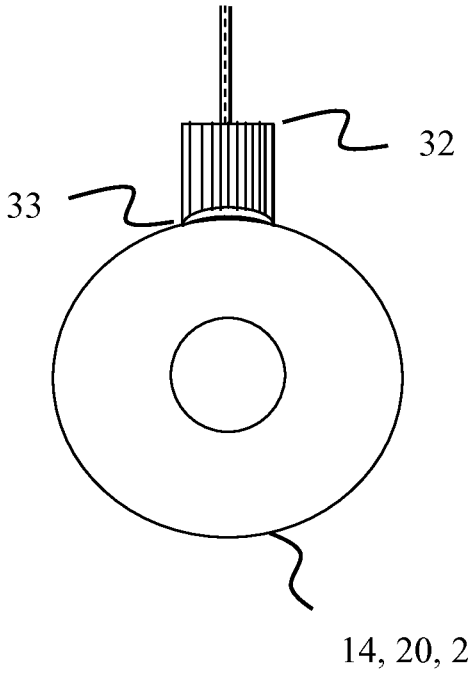
FIG. 4 shows a cross section of a solid brush.

The term "brush" does not necessarily mean that it must have fibers, bristles or hairs. A brush should be considered in the electrical sense to mean a device which conducts current between stationary wires and moving parts. For example a brush can be formed from solid carbon or graphite. A solid carbon brush is illustrated in FIG. 4. In FIG. 4 the solid carbon brush 32 contacts the roll 14, 20, 22 via a curved surface 33.

The brush 32 can be formed from copper, aluminum or steel wire. High resistance brushes may be made from graphite (sometimes with added copper). Graphite/carbon powder can be used to form the brush 32. If the brush 32 is solid, binders may be mixed in so the powder holds its shape when compacted. (Mostly phenol, other resins or pitch). Other additives include metal powders, and solid lubricants like $MoS_2$ or $WS_2$.

An alternative to the brush is a slip ring. A slip ring (in electrical engineering terms) is an electrical connection through a rotating assembly. Slip rings, also called rotary electrical interfaces, rotating electrical connectors, collectors, swivels, or electrical rotary joints, are commonly found in electrical generators for AC systems and alternators and in packaging machinery, cable reels, and wind turbines. One of the two rings is connected to one end of the field winding and other one to the other end of the field winding.

A slip ring may be formed from of a conductive circle or band mounted on a shaft and insulated from it. Electrical connections from the rotating part of the system, such as the rotor of a generator, are made to the ring. Fixed contacts or brushes run in contact with the ring, transferring electrical power or signals to the exterior, static part of the system.

Figure 5:
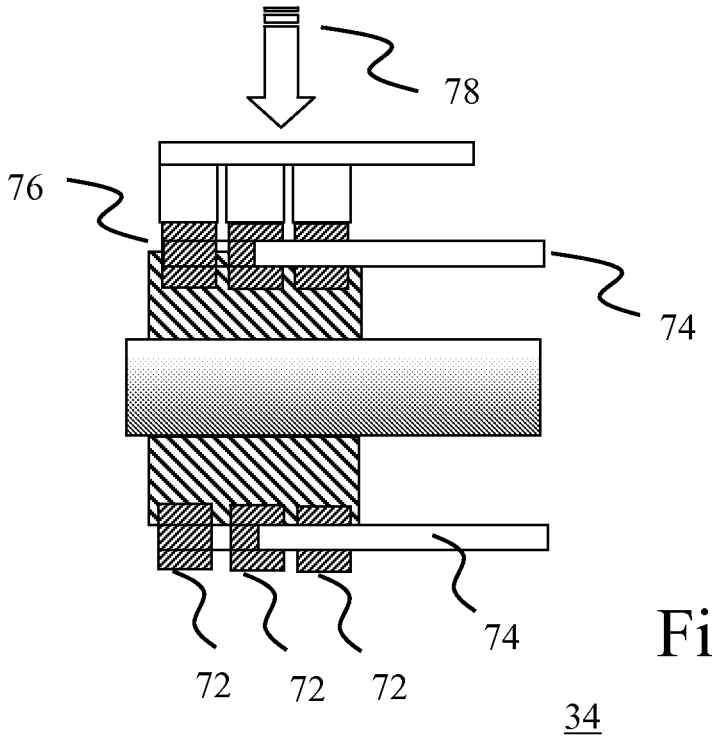
FIG. 5 shows an example of a slip ring.

FIG. 5 shows an example of a slip ring. The configuration in FIG. 5 shows both slip rings 72 and brushes 76 with electrical connections provided by short circuit bolts 74. A spring may provide pressure 78 on the roll in order to keep the assembly activated.

Figure 6:
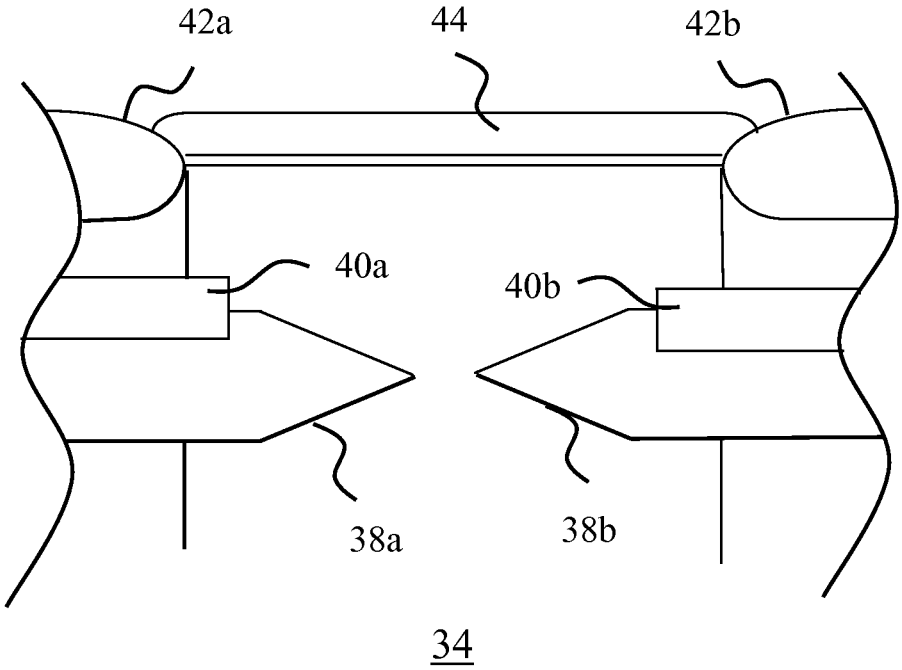
FIG. 6 shows an example of the arc gap.

FIG. 6 shows an example of the arc gap 34. The arc gap 34 can be delimited by pointed arc elements 38*a*, 38*b* that can be made of any suitable material such as copper, aluminum, graphite, steel, iron, tin, silver, gold, etc. The arc elements 38*a*, 38*b* can also be composites such as glass coated with a conductive material such as indium tin oxide or indium zinc oxide. Conductive bands of wire 40*a*, 40*b* connect the respective arc elements with the charge collector and the ground. The arc elements 38*a*, 38*b* may be mounted on posts 42*a*, 42*b* formed from non-conductive material such as plastic, wood or glass. The posts 42*a*, 42*b* may be kept in position relative to each other by being attached to a backing 44.

The arc elements 38*a*, 38*b* may be manually shifted to achieve the desired gap. Alternatively, the posts can be mounted in a goniometer or a jig (not shown) and the gap adjustment can be performed mechanically. The arc gap may be between about 0.1 and 0.01 inches. In a preferred embodiment, the arc gap may be between about 0.05 and 0.075 inches, more preferably 0.07 and 0.075 inches.

The arc gap could be bridged by a high resistance or high impedance element. For example, a resistor or other impedance element whose resistance is greater than the impedance provided by the air gap would result in a closed circuit that nevertheless operates on the same principle as the depicted embodiments, because the accumulated static electricity at one post would still discharge through the air to the other post before it would pass through the bridging resistor.

Figure 7:
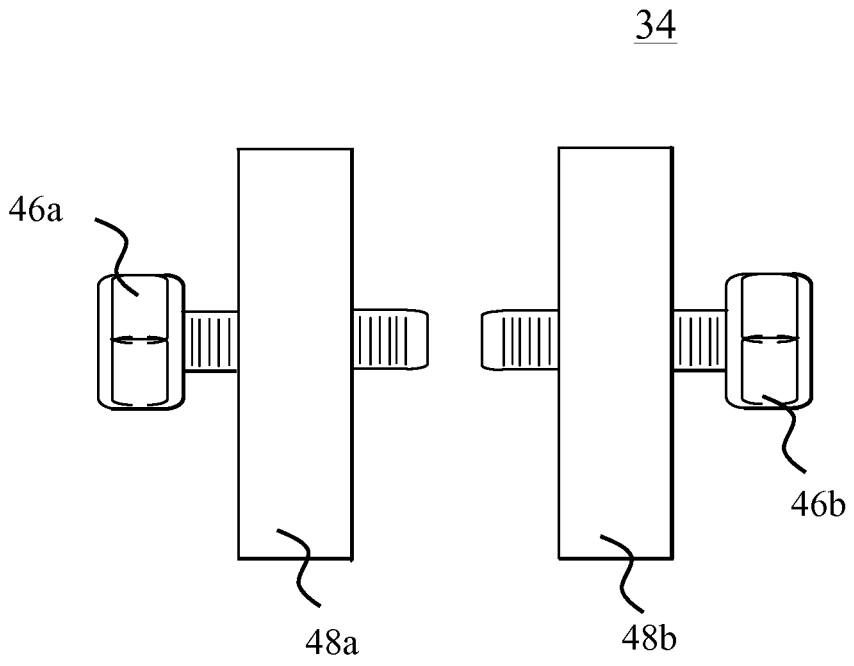
FIG. 7 is a cross sectional view of an alternative embodiment of the arc gap.

FIG. 7 is a cross sectional view of an alternative embodiment of the arc gap 34. Here, conductive screws 46*a*, 46*b* are threaded into respective non-conductive posts 48*a*, 48*b*. The gap is set by turning at least one of the screws. The screws can have pointed or flat tips and may be made of any suitable conductive material such as steel, aluminum or copper. The tips of the screws can be coated with a material such as copper or graphite in order to achieve the optimal arc properties.

The screw sizes may range from #000 to #14. Starting at #0 size which is about 0.060 inch at the thread's major diameter, all sizes above this (1-14) are larger by increments of about 0.013 inch. A "four forty" screw is a #4 screw with about 40 threads per inch. A "six thirty-two" is a #6 screw with about 32 threads per inch. An "eight thirty-two" is a #8 screw with about 32 threads per inch. A "ten thirty-two" screw is a #10 screw with about 32 threads per inch.

Figure 8:
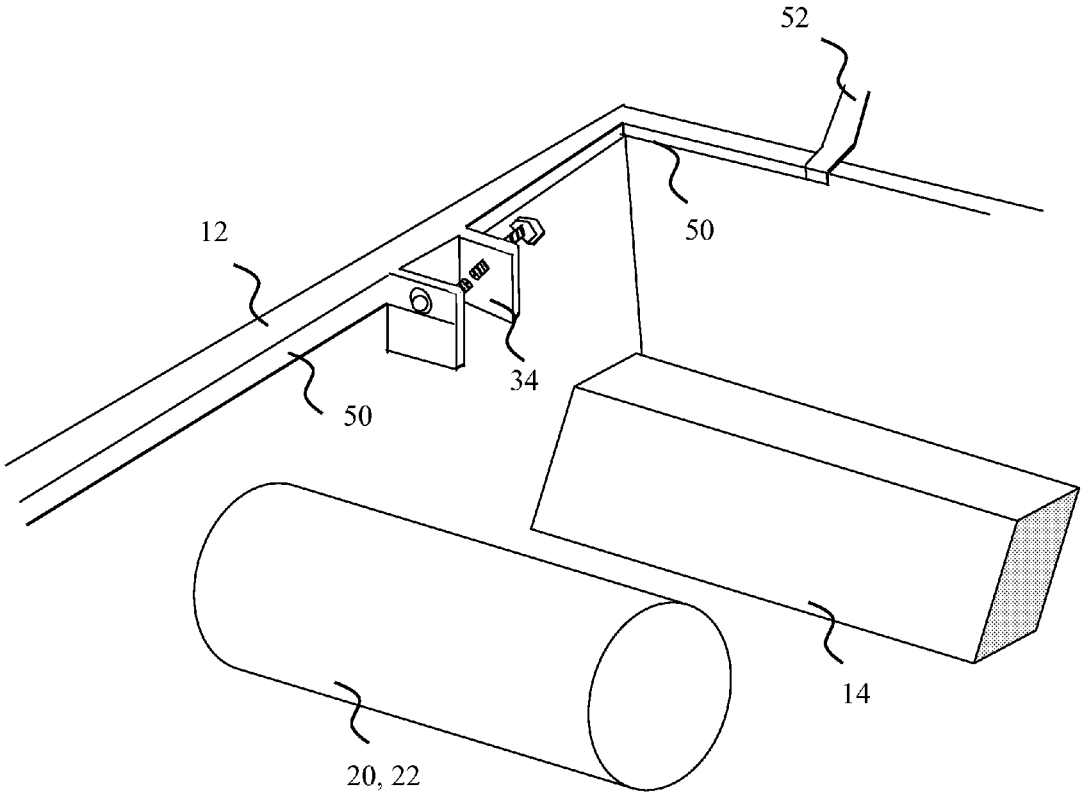
FIG. 8 shows the arc gap mounted inside the casing of the dispenser.

FIG. 8 shows the arc gap 34 inside the casing 12 of the dispenser. The dispenser contains the various components such as the feed 14 and rollers 20, 22. A copper wire or band 50 runs inside the casing to connect the arc gap 34 to the static electricity source. The wire or band 50 leading away from the arc gap 34 terminates in a lead 52 that is directed to ground.

The term "ground" as used herein embraces not only a true electrical ground but also surfaces and bodies that are relatively more electrically grounded that the dispenser embodying the invention, e.g., the wall on which the dispenser is mounted, even if the wall is not itself formed of a conductive material.

Figure 9:
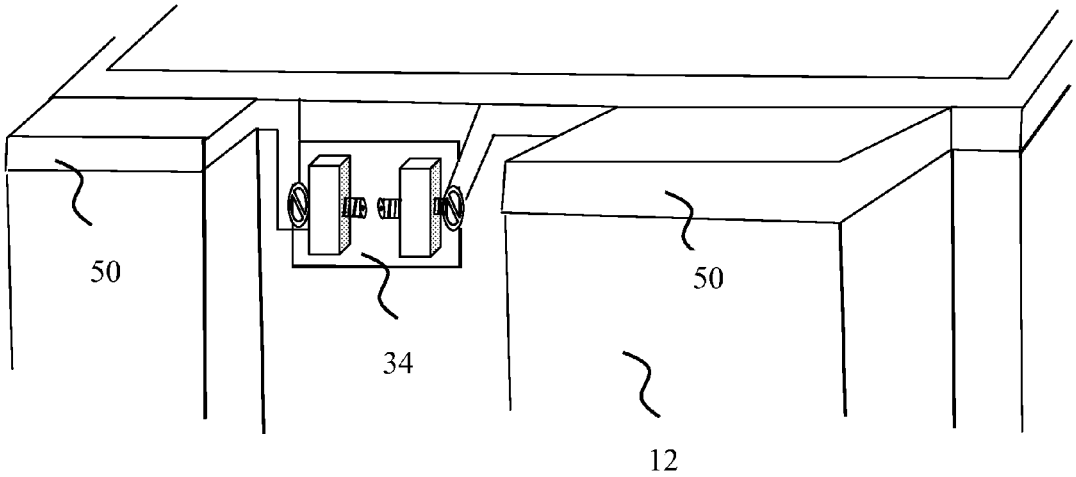
FIG. 9 shows the arc gap mounted outside the casing of the dispenser.

FIG. 9 shows the arc gap 34 positioned outside the casing 12 of the dispenser. Copper wires or bands 50 run outside the casing and connect one of the arc elements defining the arc gap 34 to the static electricity source, and the other arc element to ground. The band 50 terminates in a lead that is directed to ground. The band can be of any appropriate width, including about ⅛ inch, about 3/16 inch, about ¼ inch, about 5/16 inch, about ⅜ inch, etc. in further increments up to about 3 inches in width.

Although one arc gap is used in the examples, more than one arc gap can be used. Different arc gaps can be used for different charge generating sites. There can also be different arc gap to different ground configurations for different charge generating sites.

Figure 10:
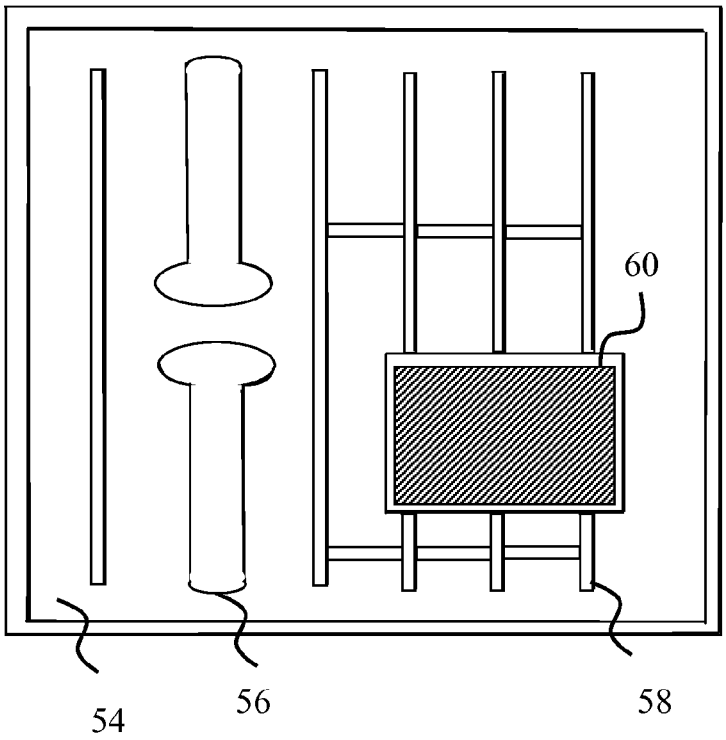
FIG. 10 shows one option for the ground.

FIG. 10 shows one option for the ground. The ground 60 may be mounted on the rear panel 54 of the dispenser. The rear panel can include such features as air holes 56 and parallel and crossing reinforcing bars 58. The ground 60 is mounted on the panel such that it can be accessed from either the inside or the outside of the dispenser.

Figure 11:
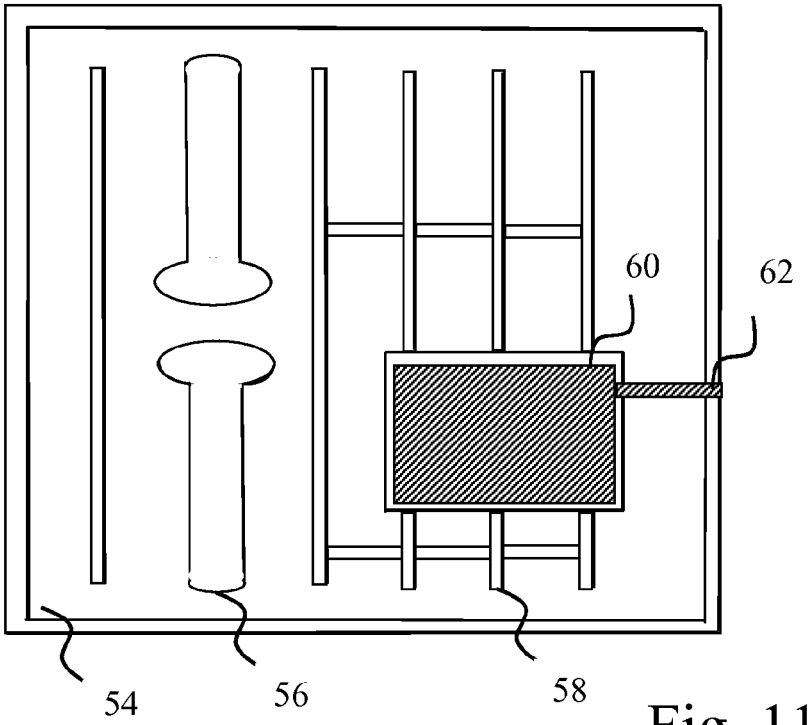
FIG. 11 shows a connection option for the ground, where a lead is on the outside of the rear panel.

FIG. 11 shows a connection option for the ground 60, where a lead 62 is on the outside of the rear panel 54 and can be connected, for example, to the conductive band 50 shown in FIG. 9.

Figure 12:
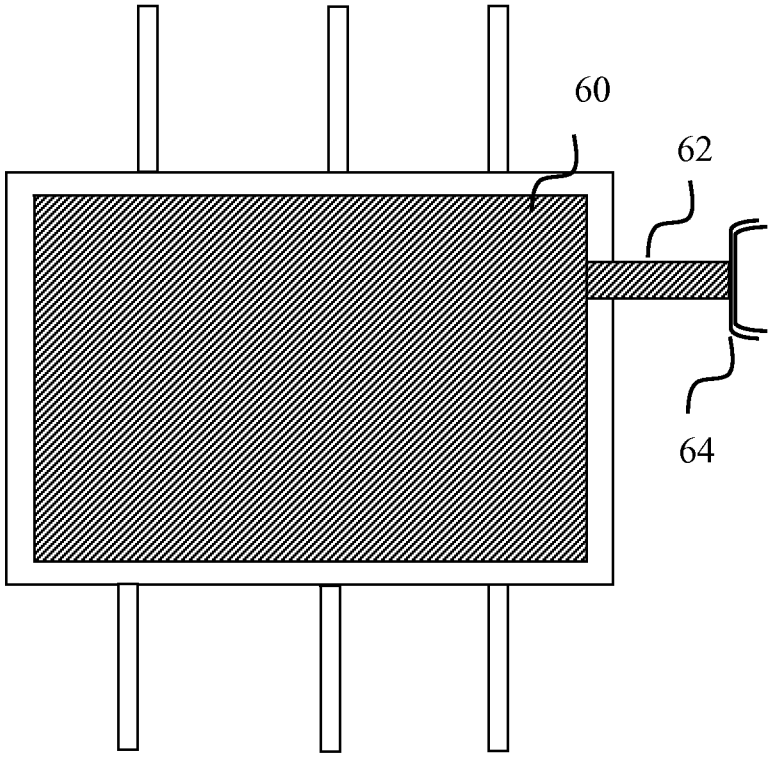
FIG. 12 shows another connection option for the ground.

FIG. 12 shows another connection option for the ground 60, where the lead 62 is taken inside of the rear panel and can be connected, for example, to the conductive band 50 shown in FIG. 8.

The ground 60 can be formed from any suitable conductive material such as copper, steel, tin, zinc, etc. For example, the ground can be an about 2 inches by about 3 inches copper foil plate. Other sizes can be used, such as inches by about 5 inches, about 4 inches by about 4 inches, etc.

The rear panel 54 can be formed from any suitable non-conductive material such as wood, plastic, resin composite, painted metal, etc.

Figure 13:
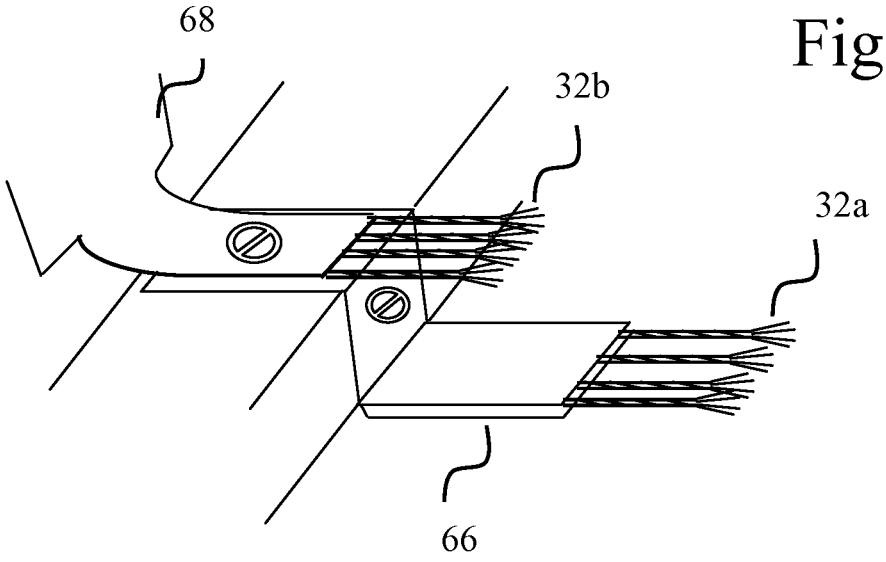
FIG. 13 shows a brush configuration that can collect static charges from more than one site.
Figure 14:
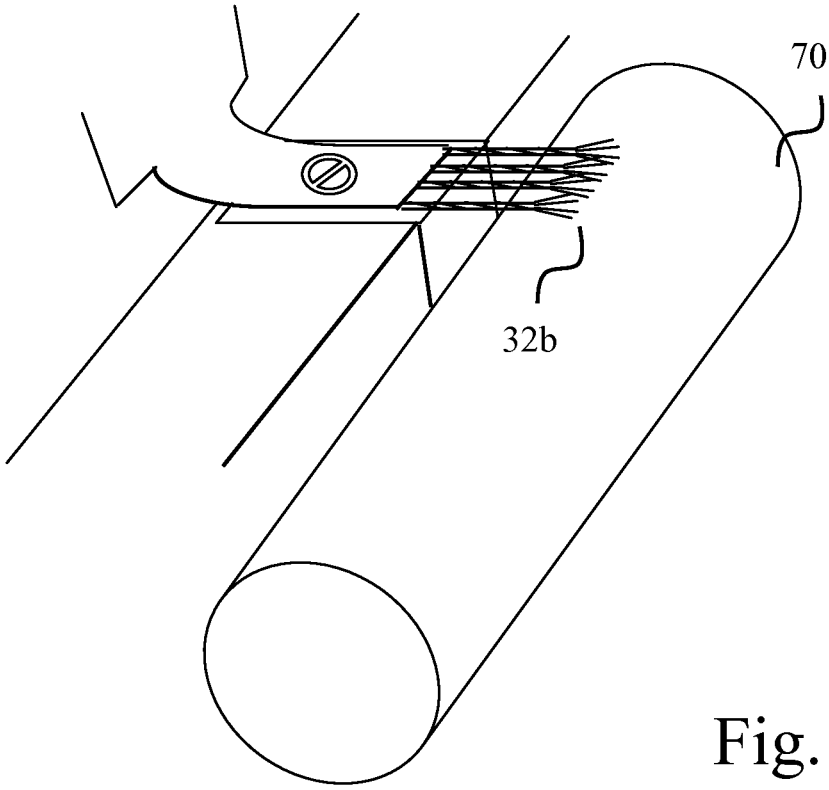
FIG. 14 shows the top row of brushes in contact with a roll.

FIG. 13 shows a brush configuration that can collect static charges from more than one site. Brushes 32*a*, 32*b* can be attached at different edges of a bent conductive plate 66 formed from copper, steel, aluminum, tin, silver, gold or other appropriate conductive material. The bends are at approximate 90° angles, but other angles can be used. The conductive band 68 (which may preferably be copper or aluminum) leads to the arc gap. FIG. 14 shows the top row of brushes 32*b* in contact with a roll 70, which can be a pinch roll (or tube), a drive roll or a guide roll.

The conductive elements used in the present invention (which include the brushes, wire or bands, arc gap elements, ground, etc.) need not be restricted to the more common materials such as copper or aluminum. They can be formed from copper, aluminum, carbon, graphite, zinc, tin, indium, gold, silver or combinations or alloys thereof. Also solders containing tin, indium, lead, etc. can be used. Conductive oxides such as ITO (indium tin oxide) or IZO (indium zinc oxide) coated on a substrate can alternative be used. Conductive polymer technology can also be utilized for the conductive parts of the dispenser. Appropriate conductive polymers may include polyacetylene, polyphenylenevinylene, polypyrrole (X=NH), and polythiophene (X=S), polyaniline (X=N, NH) and polyphenylene sulfide (X=S) and mixtures thereof, which are illustrated below.

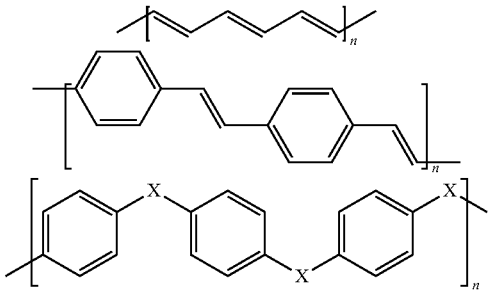

(X = NH/N, S)

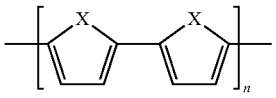

(X = NH, S)

Figure 15:
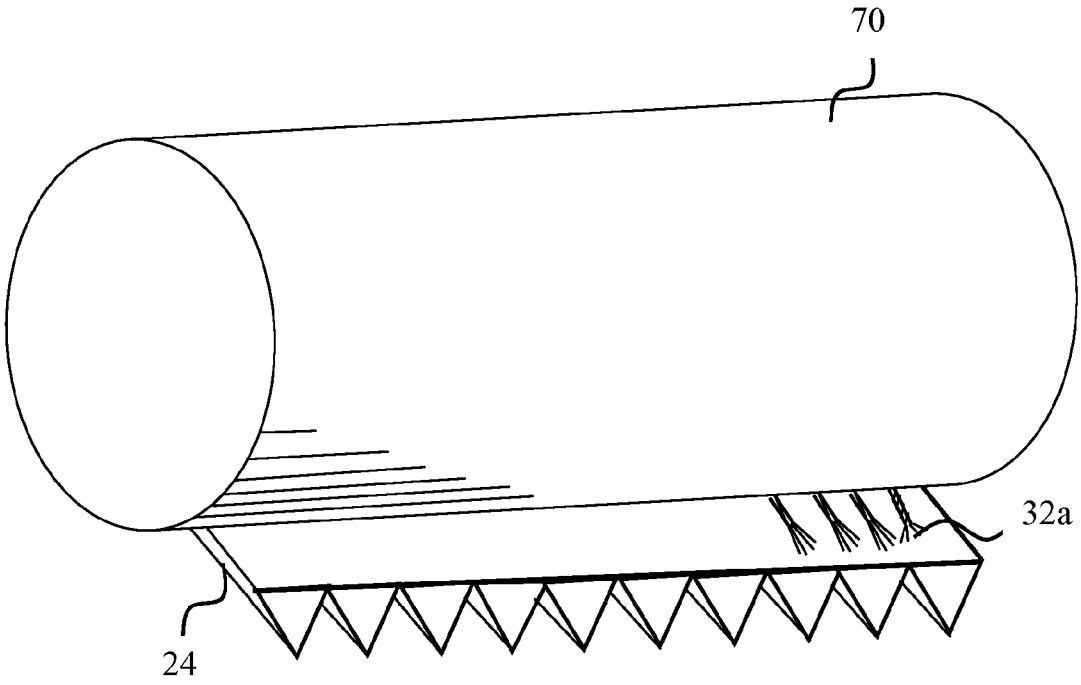
FIG. 15 shows a view where the bottom row of brushes extends out from under roll to contact the tear bar.

FIG. 15 shows a view where the bottom row of brushes 32*a* extends out from under roll 70 to contact the tear bar 24.

Figure 16:
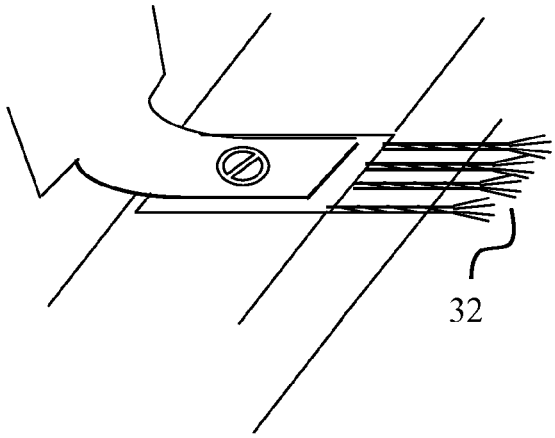
FIG. 16 shows a single row of brushes.

Also, a single row of brushes can be used, as is shown in FIG. 16. Although 4 brushes are shown there is no restriction to 4 brushes. For example, 1, 2, 3, 4, 5, 6, 7, 8, 9, 10 or more brushes in a row of brushes can be used.

In use, the device collects static electricity from rolls, bars, cutters, etc. of the dispenser that are prone to generate static charges. These charges are then sent to ground via the arc gap, which provides high impedance.

Figure 17:
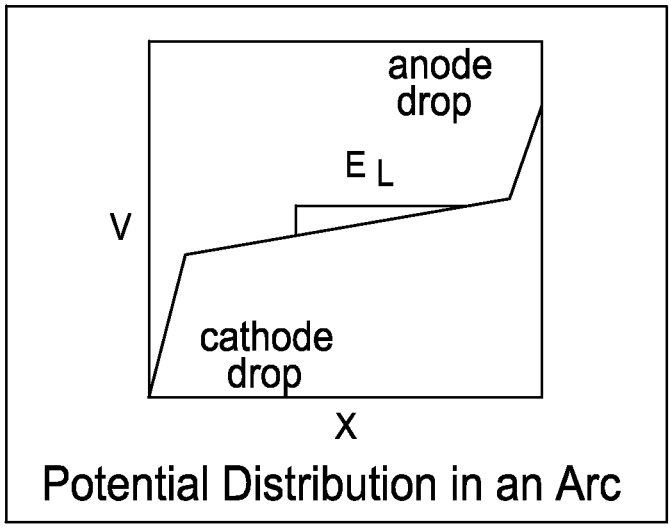
FIG. 17 shows the potential distribution in an arc as a function of distance.
Figure 18:
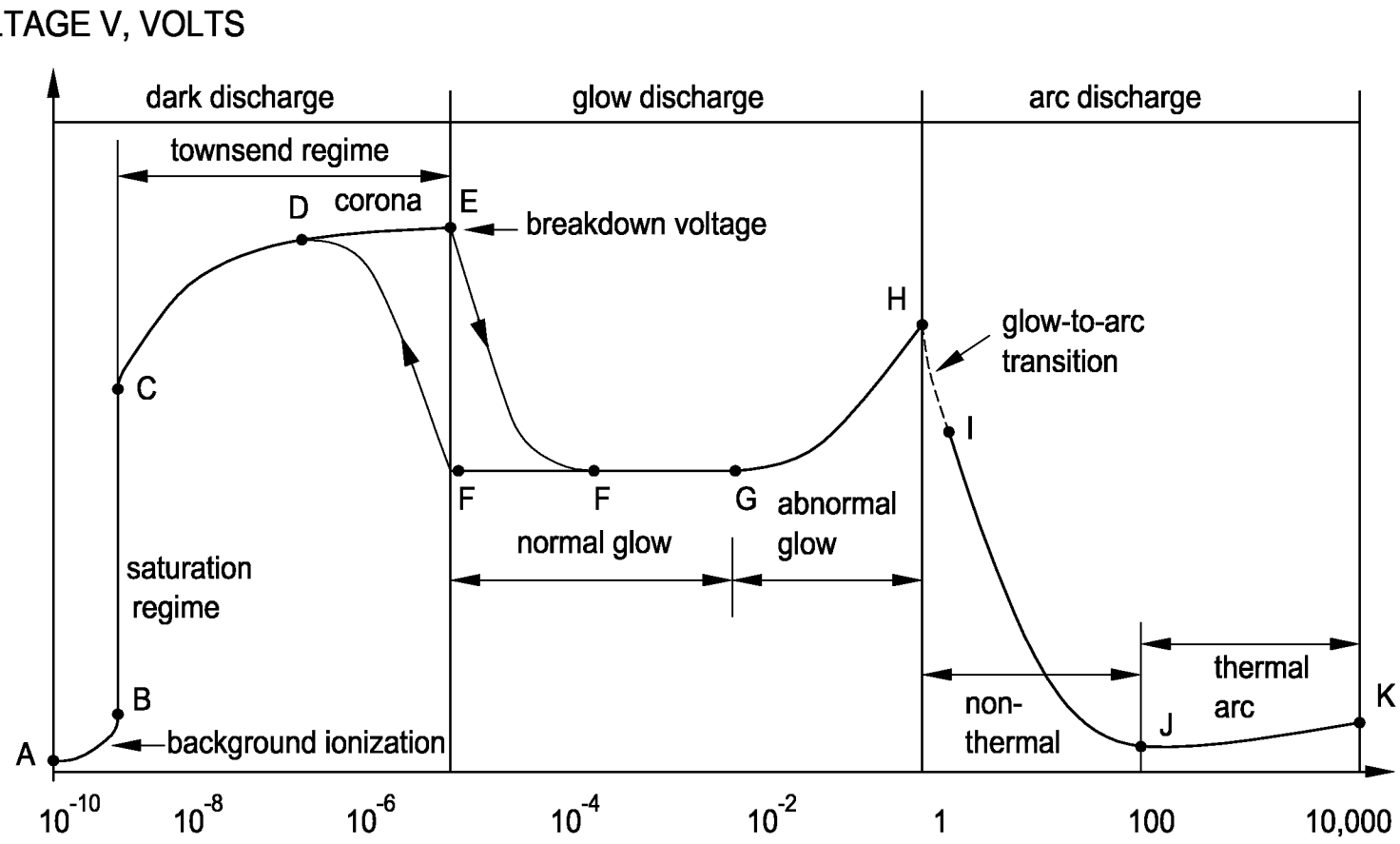
FIG. 18 shows the voltage to current relationship.

FIG. 17 shows the potential distribution in an arc as a function of distance X. At short distances there is a cathode drop that leads to the conductance regime EL. As the distance increases there is an anode drop. In this technology the conductance regime can range from about 0.1 to about 0.01 inches of arc gap, preferably being from about 0.05 to about 0.075 inches; more preferably from about 0.07 to about 0.075 inches.

The voltage to current relationship shown in FIG. 17 indicates various regimes of discharge, which can include dark discharge, glow discharge and arc discharge. As can be seen, there can be discharge even at very low currents of about $10^{-8}$ amps or less.

EXPERIMENTAL

Tests were performed using two different models of commercially-available dispensers, each of which utilizes a capacitive proximity sensor for sensing the presence of a user's hand, and initiates dispensing of a sheet of material based upon such detection. The paper used in these dispensers was oven dried paper (<1% moisture content) in an operating environment of 30% RH. The arc gap was set to within about 0.070 inches to 0.075 inches for all tests.

Tests were performed without the arc gap structure according to the invention and with the arc gap structure according to the invention. That is, in the comparative dispensers without an arc gap, neither the arc elements nor the associated conductors were provided in the dispensers. The dispensers including an arc gap according to embodiments of the invention are referred to in the results set forth below as a Static Arc Projector (SAP), also known as a Static Arc Gap (SAG).

The results are shown in Table 1.

TABLE 1

Dispenser Performance in High Static Environments.

| Dispenser | Maximum Static Charge, kV/in | Towels Overdelivered: Sensor Mode | Towels Overdelivered: Hang Mode | Comment |
|---|---|---|---|---|
| Model A without SAP | −9.3 | 25 | 40 | Data presented for first 20 pulls; after 20 pulls, some specimens spontaneously dispensed entire roll after a few pulls (hang mode). Static charge on dispenser would exceed −20 kV after full roll is dispensed |
| Model A with SAP | −2.5 | 0 | 0 | Data presented for full roll; dispenser worked as intended without intermittent dispenses or not performing as intended |
| Model B without SAP | Not tested | Not Tested | Not Tested | Data presented for first 20 pulls; after 20 pulls, some specimens spontaneously dispensed entire roll after a few pulls (hang mode). Static charge on dispenser would exceed −20 kV after full roll is dispensed |
| Model B with SAP | −2 | 0 | 0 | Data presented for full roll; dispenser worked as intended without intermittent dispenses or not performing as intended |

Notes:

1. Sensor Mode is selected by switching hand sensor on. In proper operation, dispenser must sense hand and deliver only 1 towel before it is torn off. User must tear towel off to arm sensor for next dispense cycle.
2. Hang Mode is selected by switching hand sensor off. In proper operation, a towel is always presented from dispenser mouth the next towel is automatically dispensed when user tears off towel. Only one towel should be dispensed at a time.
3. Each mode was run with 1 roll of paper dried overnight @ 175° F., and in a humidity controlled room at 80° F. and 26% RH The results show that the incorporation of the SAP more effectively prevents spontaneous dispensing arising from the buildup of static electricity, than do dispensers in which no provision is made for removing static electricity.

Test were also performed in these dispensers by providing a conductive path for removing static electricity, i.e., a continuous wire without provision of an arc gap according to the invention (see, e.g., U.S. Pat. No. 6,871,815). In those tests it was found that that the capacitive sensor operation was intermittent or not performing as intended, in that the dispenser either dispensed paper when a user's hand was not near, and thus the sensor was oversensitive; or, the sensor was non-responsive and paper was not dispensed even when a user's hand was within range of the sensor.

Without wishing to be held to any particular theory, it is believed that the provision of an arc gap according to the present invention not only removes accumulated static electricity but also effects an ionization of the atmosphere and dispenser surfaces in the vicinity of the arc gap. That ionization in turn better protects the dispenser electronics and forestalls the re-accumulation of static charge upon resumed operation of the dispenser.

Additional advantages arise from having the arc located away from the electronics, so as to reduce the likelihood of electronic malfunction arising from static charges. This is effected by the accumulation of point charges at the arc gap, which effectively functions as a capacitor when not in arcing mode. The result is a better dissipation of the static electricity that accumulates on the insulating parts of the dispenser.

While the present invention has been described in connection with various preferred embodiments thereof, it is to be understood that those embodiments are provided merely to illustrate the invention, and should not be used as a pretext to limit the scope of protection conferred by the true scope and spirit of the appended claims.

What is claimed is:

1. A dispenser comprising:

a housing that includes a compartment for storing a roll of paper towels or a stack of folded paper towels;

a slot in a wall of the housing through which individual sheets of the roll of paper towels or the stack of folded paper towels are passed;

a charge collector arranged within the housing so as to contact the individual sheets of the roll of paper towels or the stack of folded paper towels as they move within the housing;

an arc gap; and a grounded conductor, the arc gap being between the charge collector and the grounded conductor.

2. The dispenser according to claim 1, wherein the arc gap is from about 0.1 to about 0.01 inches.

3. The dispenser according to claim 1, wherein the arc gap is from about 0.05 to about 0.075 inches.

4. The dispenser according to claim 1, wherein the charge collector is at least one conductive brush or slip ring.

5. The dispenser according to claim 4, wherein the at least one conductive brush or slip ring is formed from graphite, copper, aluminum or steel.

6. The dispenser according to claim 1, wherein the arc gap is adjustable.

7. The dispenser according to claim 1, wherein the arc gap is formed from copper, aluminum, graphite, steel, iron or tin.

8. The dispenser according to claim 1, wherein the arc gap is formed from two pointed electrodes.

9. The dispenser according to claim 1, wherein the arc gap is formed from two electrodes having flattened faces.

10. The dispenser according to claim 9, wherein the two electrodes are screws.

11. The dispenser according to claim 1, wherein the charge collector, the arc gap and ground are connected conductive bands or wire.

12. The dispenser according to claim 11, wherein the conductive bands or wire are located outside the housing of the dispenser.

13. The dispenser according to claim 11, wherein the conductive bands or wire are located inside the housing of the dispenser.

14. The dispenser according to claim 11, wherein the conductive bands or wire are formed from copper, aluminum, carbon, graphite, zinc, tin, indium, gold, silver, conductive polymer or combinations or alloys thereof.

15. An apparatus that can eliminate static discharge, comprising:

a housing that includes a compartment for storing a roll of paper towels or a stack of folded paper towels;

a slot in a wall of the housing through which individual sheets of the roll of paper towels or the stack of folded paper towels are passed;

a charge collector that is at least one conductive brush and at least one slip ring, the charge collector arranged within the housing so as to contact the individual sheets of the roll of paper towels or the stack of folded paper towels as they move within the housing;

an arc gap; and a grounded conductor, the arc gap being between the charge collector and the grounded conductor.

16. The apparatus according to claim 15, wherein the arc gap is from about 0.1 to about 0.01 inches.

17. The apparatus according to claim 15, wherein the arc gap is from about 0.05 to about 0.075 inches.

18. The apparatus according to claim 15, wherein the apparatus is a dispenser.

19. The apparatus according to claim 15, wherein the charge collector is at least one row of conductive brushes formed from graphite, copper, aluminum or steel.

20. A method for removing electrostatic charge from a dispenser, comprising:

dispensing individual sheets of a roll of paper towels or a stack of folded paper towels through a slot in a wall of the dispenser in which the roll of paper towels or the stack of folded paper towels is enclosed;

collecting charge from at least one charge generating site with at least one charge collector arranged within the dispenser so as to contact the individual sheets of the roll of paper towels or the stack of folded paper towels as they move within the dispenser; and sending the charge to ground through an arc gap, the arc gap being between the at least one charge collector and the ground.

* * * * *